US012799764B2

(12) United States Patent
Witter

(10) Patent No.: US 12,799,764 B2
(45) Date of Patent: Nov. 17, 2026

(54) UTILITY POLE LIFTING MECHANISM WITH SAFETY SLING

(71) Applicant: Clayton Joseph Witter, King George, VA (US)

(72) Inventor: Clayton Joseph Witter, King George, VA (US)

( * ) Notice: Subject to any disclaimer, the term of this patent is extended or adjusted under 35 U.S.C. 154(b) by 0 days.

(21) Appl. No.: 19/274,024

(22) Filed: Jul. 18, 2025

(65) Prior Publication Data

US 2026/0043263 A1 Feb. 12, 2026

Related U.S. Application Data

(60) Provisional application No. 63/680,806, filed on Aug. 8, 2024.

(51) Int. Cl.
*E04H 12/34* (2006.01)

(52) U.S. Cl.
CPC ..... *E04H 12/345* (2013.01)

(58) Field of Classification Search
CPC ..... E04H 12/345; B66C 1/585; B66C 1/12; B66C 1/122; B66C 3/04; A01G 23/006; B60P 3/41; B60P 7/12; B25J 15/00; B25J 15/0014; B25J 15/0028; B25B 5/00; B25B 5/04; B25B 5/02; B25B 5/16; B25B 5/163
USPC ..... 269/86, 89.92; 294/201, 86.1; 414/734, 414/703, 739
See application file for complete search history.

(56) References Cited

U.S. PATENT DOCUMENTS

| | | | | |
|---|---|---|---|---|
| 2,452,452 | A * | 10/1948 | Girnus | B66C 3/04 294/112 |
| 2,754,769 | A * | 7/1956 | James | B62D 33/0215 280/145 |
| 4,072,303 | A * | 2/1978 | Szabo | B25B 5/06 269/238 |
| 5,061,150 | A | 10/1991 | Rentschler | |
| 5,415,449 | A | 5/1995 | Kentner, Sr. | |
| 5,620,298 | A | 4/1997 | Barwise | |
| 5,964,557 | A * | 10/1999 | Eng | B60P 3/41 410/32 |
| 6,254,074 | B1 * | 7/2001 | Di Padova | B25B 5/06 269/239 |
| 2005/0111962 | A1 * | 5/2005 | Whitehead | B65D 90/006 414/800 |
| 2011/0224055 | A1 * | 9/2011 | Kassel | A63B 23/0355 482/121 |
| 2025/0066165 | A1 | 2/2025 | Garrison et al. | |

* cited by examiner

*Primary Examiner* — Gregory W Adams
(74) *Attorney, Agent, or Firm* — PATENT PORTFOLIO BUILDERS PLLC

(57) ABSTRACT

A mechanism adapted to safely lift utility poles from the ground to an upright position (or vice versa) is described. The mechanism includes a set of lifting tongs, having a first and second arm, each arm having a pointed end adapted to grip a utility pole, a first connection mechanism on said first arm, a second connection mechanism on said second arm, and a safety sling connectable to said first connection mechanism and said second connection mechanism.

17 Claims, 8 Drawing Sheets

UTILITY POLE LIFTING MECHANISM WITH SAFETY SLING

RELATED APPLICATION

This application claims priority from, and incorporates by reference, U.S. Provisional Ser. No. 63/680,806, entitled "UTILITY POLE LIFTING MECHANISM WITH BUILT-IN SAFETY SLING", filed on Aug. 8, 2024.

TECHNICAL FIELD

Some embodiments of the subject matter disclosed herein generally relate to methods, apparatuses, and systems associated with moving utility poles (and the like) in a safe and reliable manner.

BACKGROUND

The electric power industry is an essential component of the Industrial Revolution and supplies energy that enables computers, cars, homes, lights, and so many other devices and systems to operate. It would not be overstating its importance to say that without electricity, modern society as we know it would be a very different thing.

Utility companies supply electricity for residential, industrial, and commercial uses, most commonly via electrical transmission lines. These transmission lines are typically carried above-ground via utility poles (although some transmission lines are buried). In addition to building new transmission lines that require new utility poles to be installed, utility poles also periodically need to be replaced due to, e.g., age or damage. As will be appreciated by those skilled in this art, utility poles vary in size, for example, between about 35 feet-120 feet tall and weigh anywhere from about 800 to 4,000 or more pounds. Thus, erecting new (or replacing old) utility poles requires substantial lifting equipment and trained operators.

An example of lifting equipment that can be used to erect utility poles is shown in FIG. 1. A truck 100 with a heavy-duty crane 102 attached thereto is poised to lift an end of utility pole 104. Initially, a set of grabbing tongs 106 is used to lift the pole 104 a few feet off the ground. Grabbing tongs 106 have a pair of arms 108 and 110, which are designed to pincer the pole 104 as it is being lifted, i.e., each of the arms 108, 110 have sharp hook ends that bite into the utility pole 104 as the crane 102 lifts the grabbing tongs 106. Dixie Industries makes an example of grabbing tongs 106 under the tradename of Timber Lifting.

FIG. 2 depicts a larger view of the grabbing tongs 106 including the sharp ends 202, 204 that bite into the utility pole 104. After utility pole 104 is lifted a foot or two off of the ground, a current best practice in the utility industry is to further secure utility pole 104 by wrapping a chain 206 around the entire lifting assembly as shown in FIG. 2. The chain 206 can be connected via a shackle or loop.

However, while wrapping the chain 206 around the assembly is considered to be a best practice in the industry (for safety reasons), the Inventor has found that in many situations in the field workers sometimes skip this step since it more or less doubles the amount of time involved in lifting the utility pole 104. Workers feel that the extra choking chain 206 is an extra element to carry and adds to time in the elements, wears on the worker, and is a step that can be omitted. Unfortunately, if the chain 206 is not used and if the tongs 106 release their grip on the utility pole 104 while it is being lifted, the utility pole could potentially injure or even kill the worker(s) that are assisting in the pole installation, and there are a number of documented accidents that are caused by this scenario.

Another issue is that the chain 206, if it is actually used as intended to be a safety backup to the tongs, once wrapped around the utility pole 104 and its lifting assembly, becomes part of the lifting assembly itself, i.e., it is under considerable strain during each utility pole lift.

Accordingly, it would be desirable to provide equipment for lifting utility poles to overcome these drawbacks and problems.

SUMMARY

According to an embodiment, a safety strap is removably attached to a modified set of lifting tongs to act as a backup in case the tong arms release the utility pole during a lift. According to some embodiments, one end of the safety sling can be relatively easily connected to one of the arms of the lifting tongs after it is fed underneath a utility pole being lifted by the tongs. According to some embodiments, the other end of the safety sling is also removably retained by a connection mechanism on the other one of the arms of the lifting tongs, but in a manner which makes it more difficult to manually remove that end of the safety strap. This latter feature ensures that the safety strap remains associated with (connected to) the lifting tongs so that users in the field don't need to go searching for a loose safety strap.

According to one embodiment, a mechanism adapted to lift utility poles includes a set of lifting tongs, having a first and second arm, each arm having a pointed end adapted to grip a utility pole, a first connection mechanism on said first arm, a second connection mechanism on said second arm, and a safety sling connectable to said first connection mechanism and said second connection mechanism.

According to another embodiment, a method for safely lifting a utility pole from a substantially horizontal position to a substantially vertical position, includes attaching a set of lifting tongs to the utility pole, the lifting tongs having a first and second arm each with at least one tine that grips the utility pole when attached; lifting the utility pole away from a surface on which it is resting; feeding a safety sling, that is removably attached to the set of lifting tongs by a first loop on the first arm, underneath the utility pole; connecting a second loop of the safety sling to the second arm of the set of lifting tongs; and continuing to lift the utility pole to a predetermined position.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The embodiments to be discussed next are not limited to the configurations described below but may be extended to other arrangements, as discussed later.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification does not necessarily refer to the same embodiment. Further, the particular features, structures, or characteristics may be combined in any suitable manner in one or more embodiments.

According to these embodiments, an integrated combination of a safety sling with a pair of gripping tongs is described below, which addresses the shortcomings of existing utility pole lifting mechanisms described above.

Figure 1:
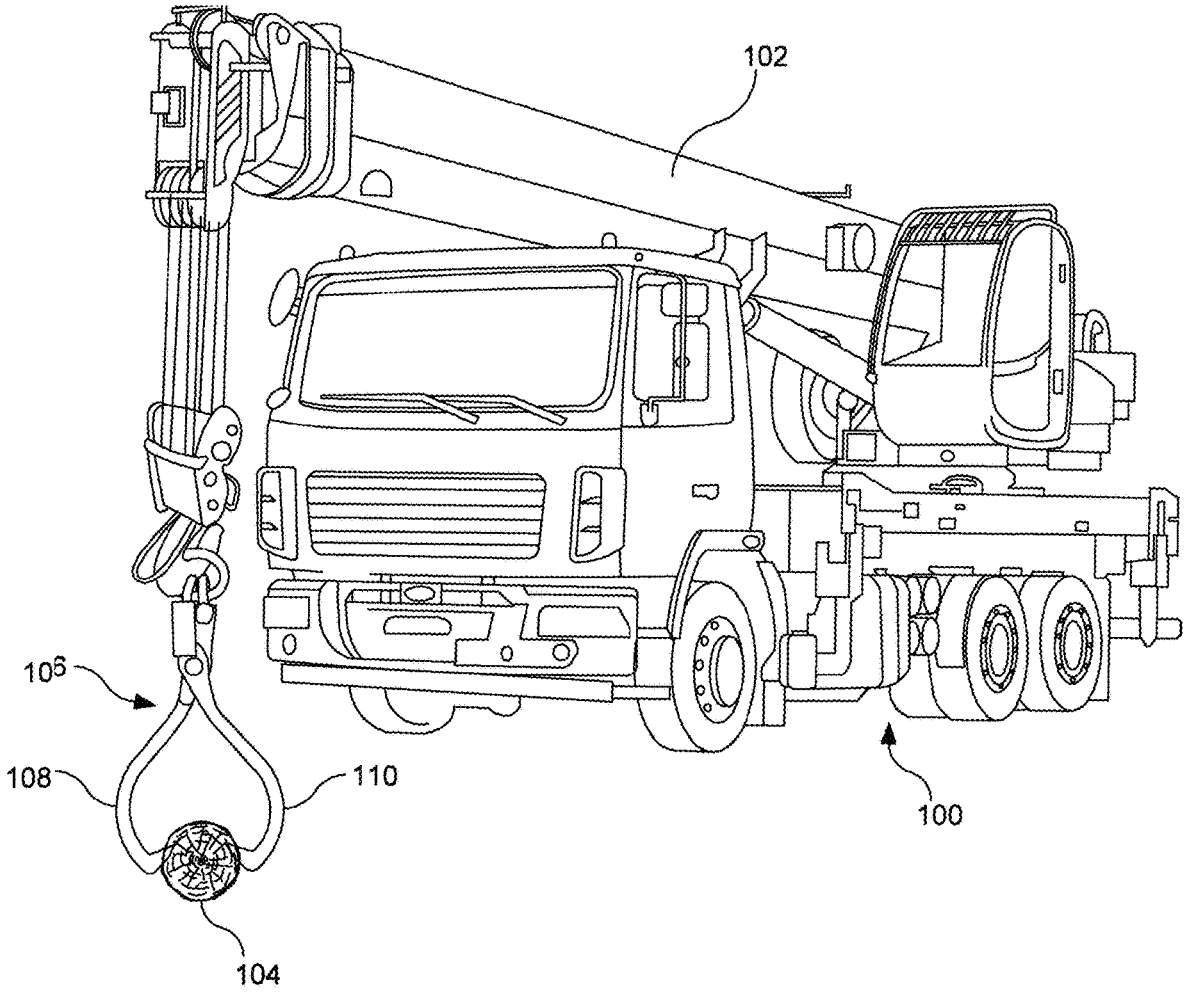
FIGURE 1 (Background Art)
FIG. 1 illustrates a truck with a crane lifting a utility pole using grabbing tongs.
Figure 2:
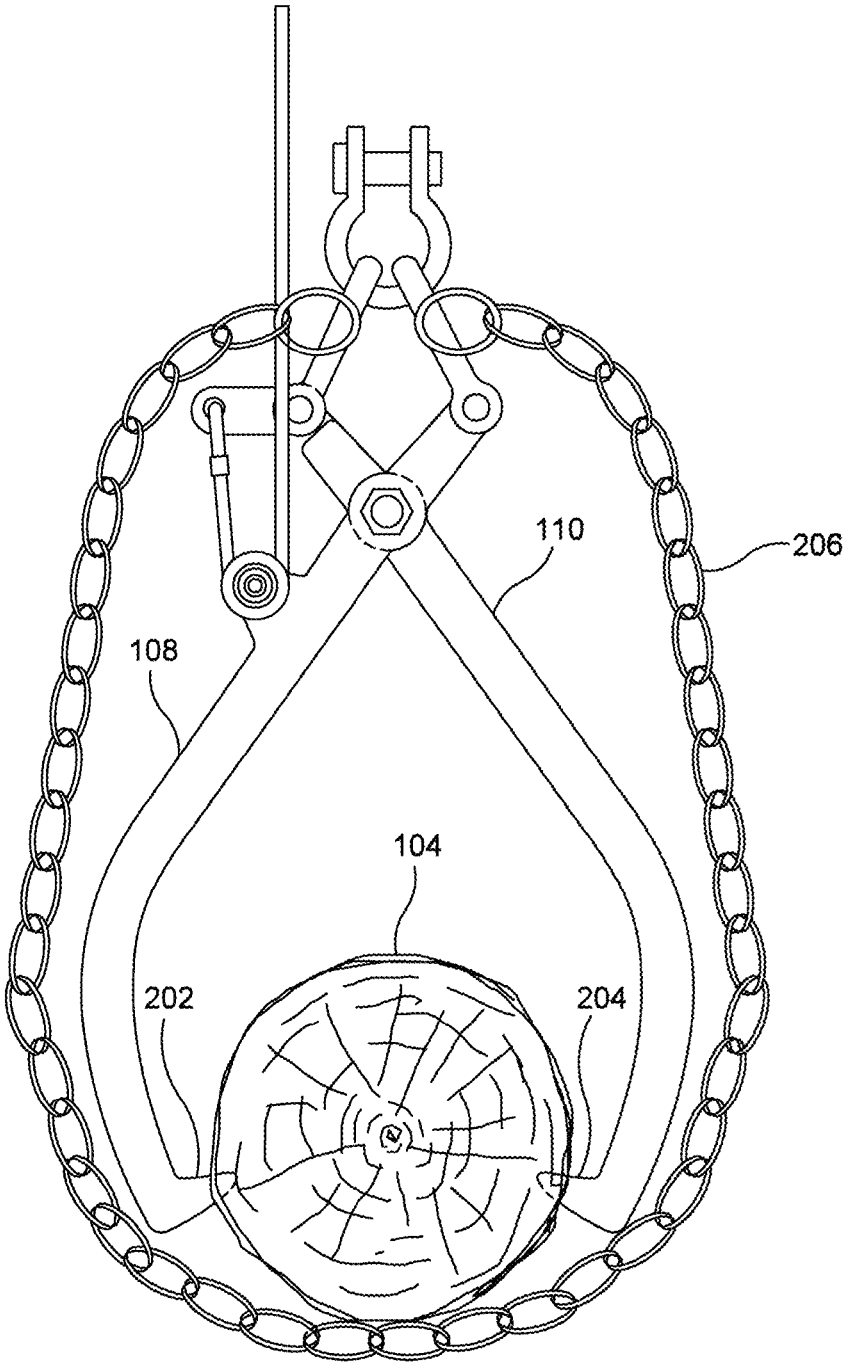
FIGURE 2 (Background Art)
FIG. 2 depicts a view of the grabbing tongs and utility pole of FIG. 1 with an additional safety chain wrapped around the lifting assembly.
Figure 3:
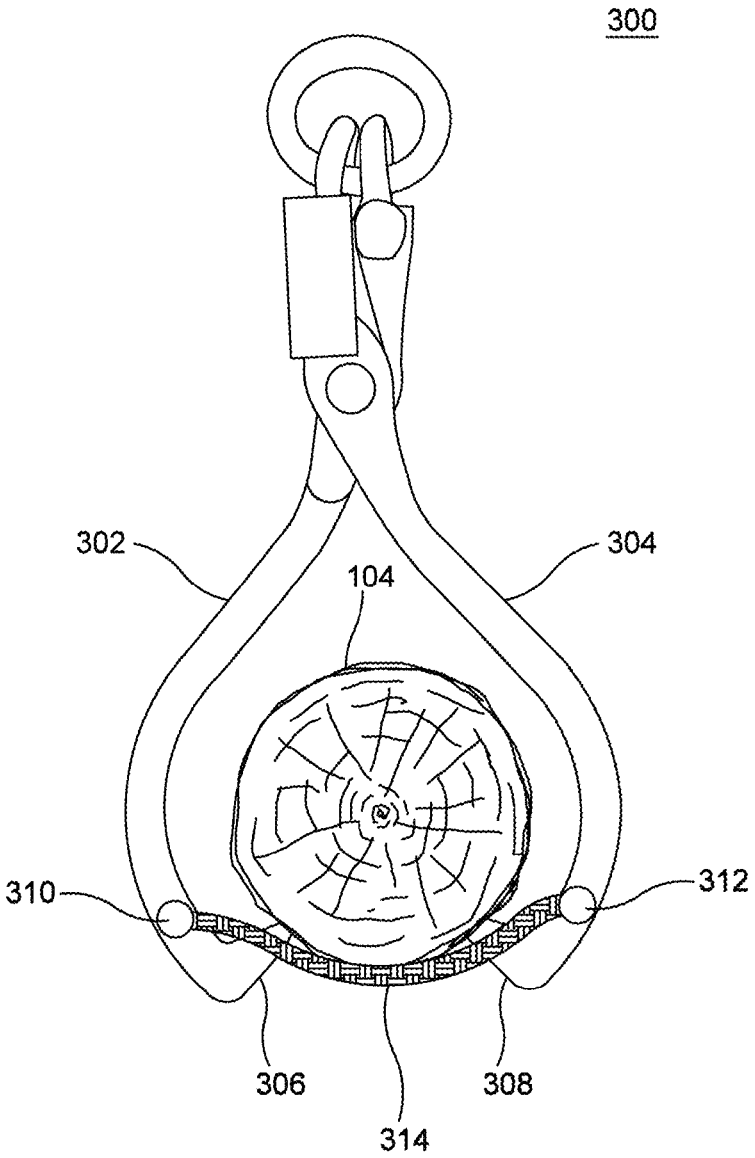
FIG. 3 is a view of gripping tongs having an integrated safety sling according to an embodiment.
Figure 4:
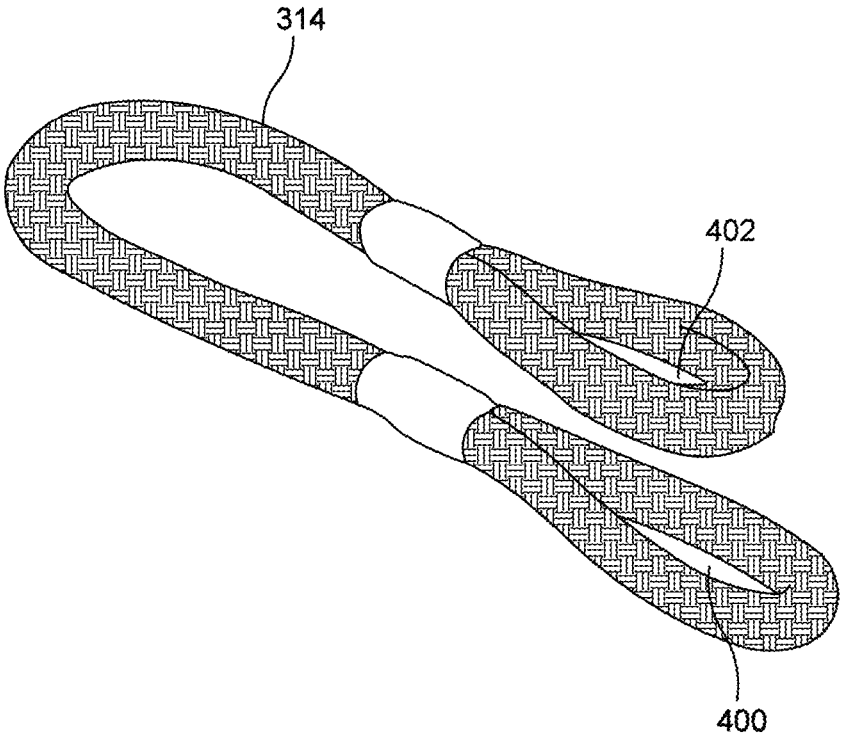
FIG. 4 illustrates a safety sling according to an embodiment.

FIG. 3 illustrates a side view of a pair of gripping or lifting tongs 300 having a pair of arms 302, 304 with sharpened ends or tines 306, 308 according to an embodiment of the present invention. Unlike the conventional pair of gripping tongs described above with respect to FIGS. 1 and 2, the gripping tongs 300 have a connection mechanism 310, 312, which enables a safety sling 314 to be attached thereto. As seen in FIG. 4, the safety sling 314 can, for example, have two open loop ends 400 and 402 according to an embodiment that can be attached to their respective connection mechanisms 310 and 312. According to one embodiment, the safety sling 314 can be partially attached to the connection mechanism 310, 312 when it is initially put into service, i.e., when the tongs 300 are used to initially raise the utility pole 104 off of the ground, by (for example) looping either the safety sling opening 400 or 402 around one of the two connection mechanisms 310 or 312. Then, after the utility pole 104 is raised off of the ground, the other one of the two safety sling openings 402 or 400 can be looped around the other connection mechanism 312 or 310 to fully secure the utility pole 104 against the possibility of the tongs 300 releasing the utility pole 104 prematurely.

The safety sling 314 can, for example, be made out of an industrial-strength cloth or fiber that is sufficiently strong to withstand the force of the utility pole 104 being released prematurely and dropping into the safety sling 314, for example, safety slings manufactured by Samson using, e.g., AmSteel-Blue® which is a high-performance 12-strand single braid of 100% Dyneema® fiber, and yields a maximum strength-to-weight ratio, very low stretch, and is stronger than the same sized wire rope. Those skilled in the art will appreciate that other materials could, alternatively, be used to fabricate the attached safety sling 314, e.g., safety sling 314 could also be a chain that is permanently (or semi-permanently) attached to the tong arms 302, 304, as described below.

Figure 5A:
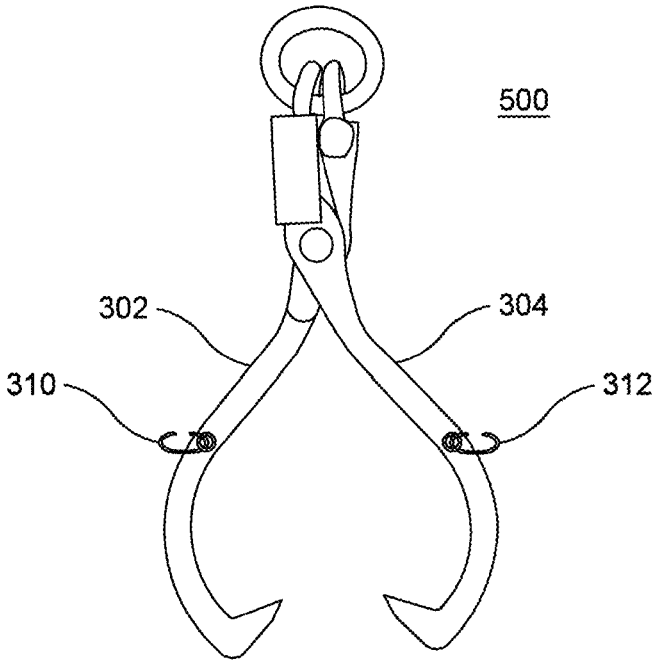
FIGS. 5A and 5B show different locations wherein connection mechanisms for attaching the safety sling to the tongs can be located according to various embodiments.
Figure 5B:
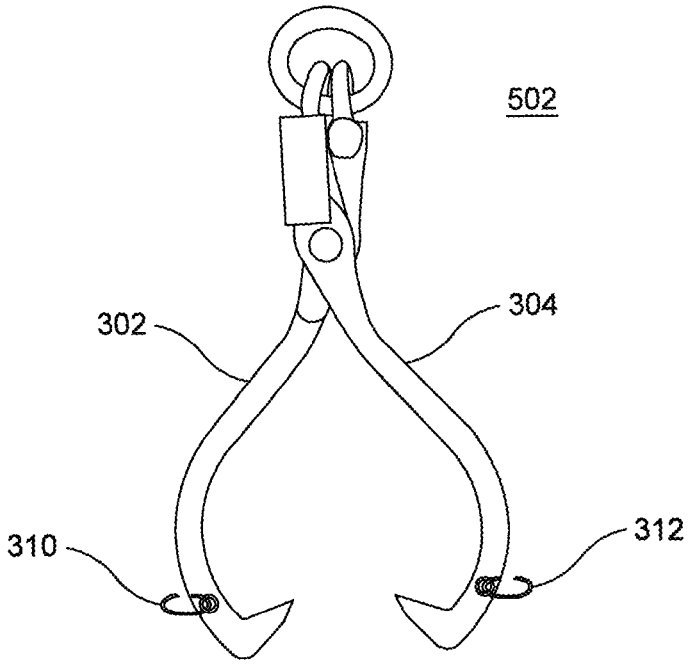

In addition to the material that the safety sling 314 is fabricated from, another aspect of these embodiments is to establish where and how to connect the safety sling 314 to the tongs 300 in a manner that is easy for workers to manage (and therefore more likely to be used than the chain in FIG. 2), safe, and also effective to bear the force of a dropped utility pole. FIGS. 5A and 5B depict embodiments with connection mechanisms in the form of hooks 310 and 312, which can connect to the safety sling openings 400 and 402. Those skilled in the art will appreciate that hooks 310 and 312 are merely examples of connection mechanisms that can be used to connect the safety sling 314 to the tongs 300. Other examples include one side, e.g., 310 or 312, having a permanently welded or forged (chain) and the other side 312 or 310 having a Y Fork that is adjustable so that a worker can slip a link of the other end of the chain onto the Y Fork. Still other examples of connection mechanisms according to various embodiments including, for example, carabiners are described below.

In addition to the type of connection mechanisms 310, 312, their location on the tong arms 302, 304 may vary depending upon various embodiments. For example, as seen in FIG. 5A, connection points, in this example hooks 310 and 312, can be located at approximately a midpoint of their respective tong arms 302 and 304. Alternatively, as seen in FIG. 5B, connection hooks 310 and 312 can be located on their respective tong arms 302 and 304 closer to the sharpened ends of the tongs 300.

Figure 6:
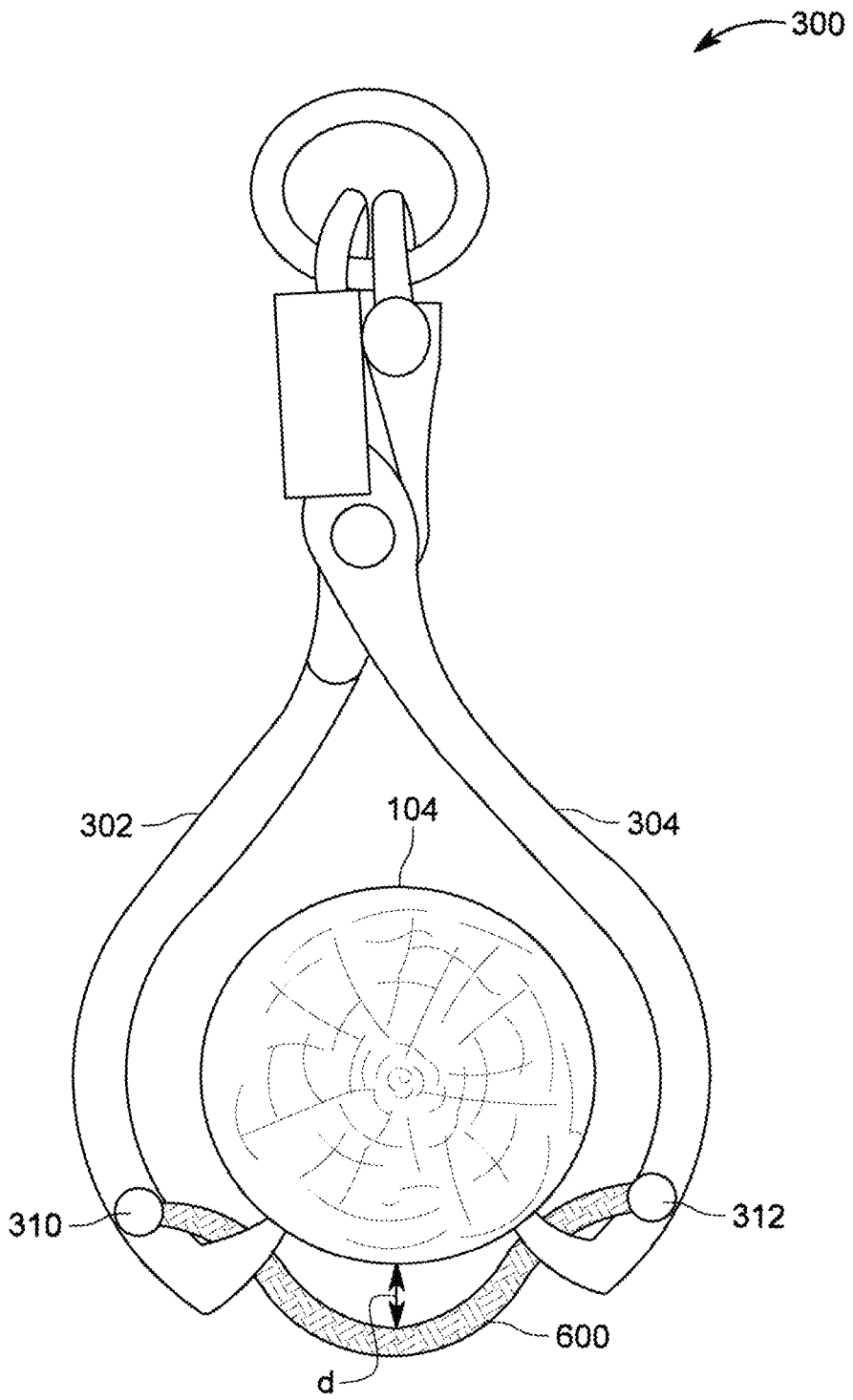
FIG. 6 shows an embodiment including a drop gap length between the utility pole and the safety sling.

One of the factors associated with the location of the connection points 310, 312 is the drop length for the pole 104 if the tong arms 302, 304 disengage during a lifting procedure. In this context, the drop length is the distance d from a bottom of the pole 104 to a top of the safety sling 600 (See FIG. 6). The amount of drop length d (or slack) between the safety sling 600 and pole 104 is a function of the length of the safety sling 600 and the location of the connection points 310, 312. The drop length d also dictates how much force/weight the safety sling 600 (and tong mechanism 300 overall) will absorb if the pole 104 becomes detached from the tong arms 302, 304. According to some embodiments, therefore, the drop length d is between 0 (i.e., the top of the safety sling 600 is touching the bottom of pole 104) and 2 feet and, more preferably, d is less than one foot in length. Note that, although shown differently in FIG. 6, the safety sling 600 is typically expected to be disposed inwardly of the tong arms 302, 304 relative to the end of the utility pole 104 in most applications.

According to some embodiments, the connection mechanisms 310, 312 are the same type of connection mechanism, e.g., hooks or the like over which loops 400, 402 in the safety sling 314, 600 slide and are attached to their respective tong arms 302, 304. According to other embodiments, the connection mechanisms 310 and 312 can be different types of connection mechanisms. For example, according to some embodiments one of the connection mechanisms (e.g., 310) can be an open ended hook which permits a user to slip a safety sling loop 400 over the hook to attach one end of the safety sling to the mechanism 300 without the use of tools. By way of contrast, the other one of the connection mechanisms (e.g., 312) can be a different type of connection mechanism which is semi-permanently attached to the other loop 402. The term "semi-permanently" in this context means that the other connection mechanism (e.g., 312) requires more effort than simply sliding the loop 402 over an open ended attachment but, instead, requires the use of a tool, a multi-step opening process, a lock, or the like to open the semi-permanent connection mechanism sufficiently to enable the loop 402 to be removed from the semi-permanent connection mechanism. By making one of the connection mechanisms 310, 312 a semi-permanent connection to safety sling 400, it is less likely that the safety sling 400 will become disassociated from the tong mechanism 300, e.g., by permitting both loops 402, 404 to slip off of the connection mechanisms 310, 312 during transport and will, therefore, be more likely to be used to provide its intended safety function in the field.

Figure 8:
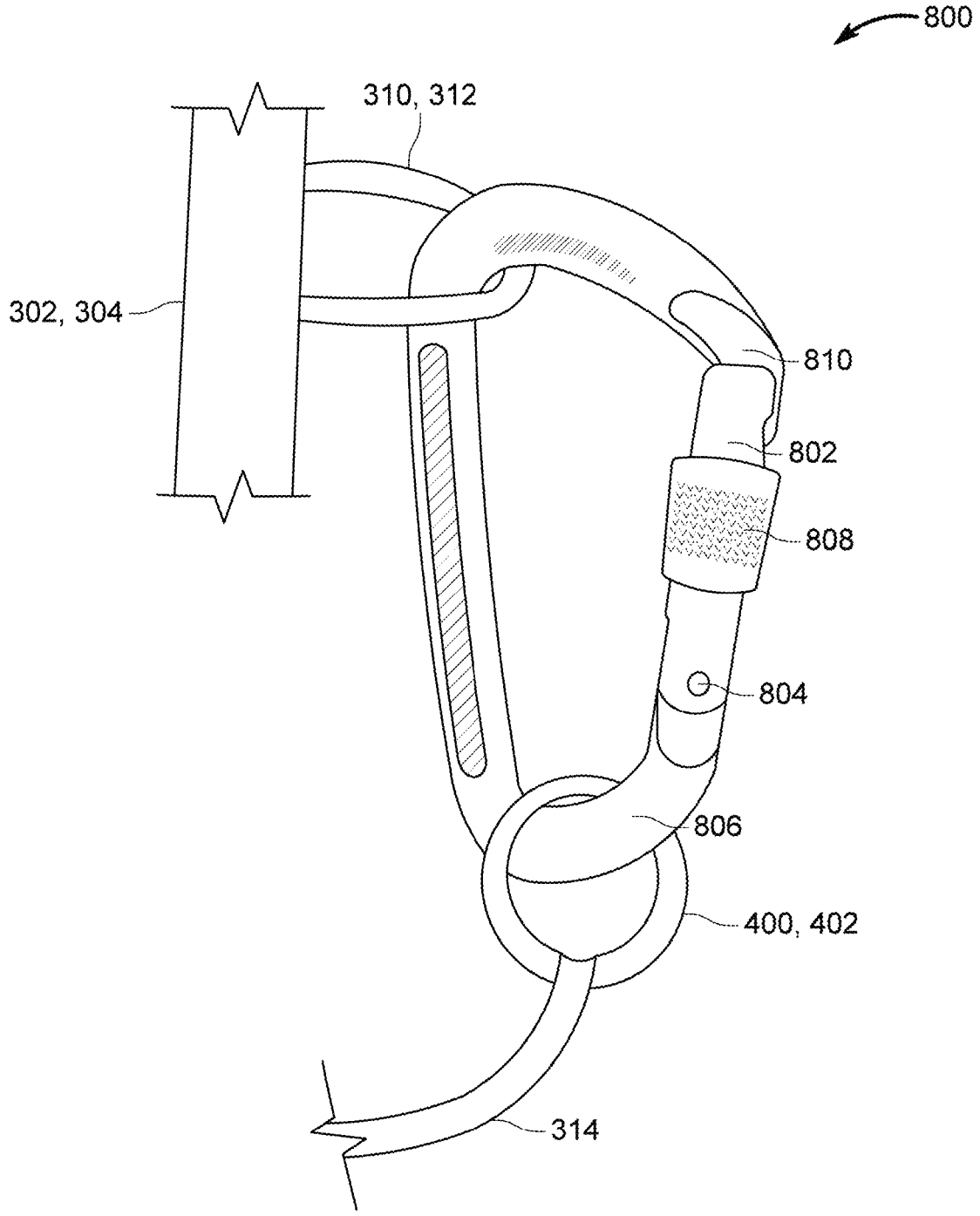
FIG. 8 depicts a carabiner as part of a connection mechanism which can be used to secure the safety strap to the lifting tongs according to some embodiments.

The semi-permanent connection mechanism 310 or 312 can take many different forms. For example, the semi-permanent connection mechanism 310 or 312 may require the removal of a screw or the like, which keeps the semi-permanent connection mechanism 310 or 312 closed relative to loop 402 or 404 until a screwdriver is used to release it. Alternatively, one or both of the connection mechanisms 310 and 312 may include a carabiner whose movable section is spring-loaded to enable them to open to accept (and retain) the loop 402 or 404 of the safety sling 304. See FIG. 8. Therein, a carabiner 800 is illustrated that is attached both to a connection point 310, 312 on the tong arms 302, 304 and to one of the loops 400, 402 of the safety sling. In operation, and assuming that this represents the more easily removable loop 400, 402, the portion 802 pivots inwardly around pivot point 804 around a spring force which tends to bias the portion 802 into the closed position as shown in FIG. 8. When the carabiner 800 is opened, e.g., after the safety sling 304 is fed under a utility pole (not shown in FIG. 8), the loop 400 or 402 can be placed around the bottom portion 806 of the carabiner 800 such that the bottom portion 806 bears the weight of the safety sling 304 (and the utility pole if it is released by the tongs).

An optional locking mechanism 808 can be provided to secure the spring-loaded portion 802 in its closed position. In this example, the locking mechanism 808 can include threads (not shown) on the interior of the locking mechanism 808 which screw on to threads (not shown) formed in portion 810 of the carabiner 800. Other types of locking mechanisms 808 could be used as alternatives depending upon whether the carabiner 800 is used as the semi-permanent connection mechanism 310, 312 or the non-semi-permanent connection mechanism 312, 310. For example, according to another embodiment, the force needed to release the movable section 802 of the carabiner 800 on the semi-permanent connection may be much greater than the force needed to release the movable section 802 of the carabiner 800 on the other connection mechanism (if carabiners are used on both sides), making the semi-permanent connection 310 or 312 very difficult (or impossible) to open manually without a tool. Alternatively, the semi-permanent connection can include a locking mechanism 808 which must be unlocked in order to remove the safety sling loop 402, 404 i.e., more than just a threaded connection, e.g., to enable replacement of the safety sling after a predetermined usage period or after an event occurs during which the safety sling 400 bears the weight of pole 104.

According to some embodiments, the connection mechanisms 310, 312 can be rings that are welded to (or forged/cast integrally with) their respective tong arms 302,304. According to other embodiments, the carabiner 800 can be directly welded to (or forged/cast integrally with) the tong arms 302, 308, thereby eliminating the need for an intervening connecting ring as shown in FIG. 8.

Figure 7:
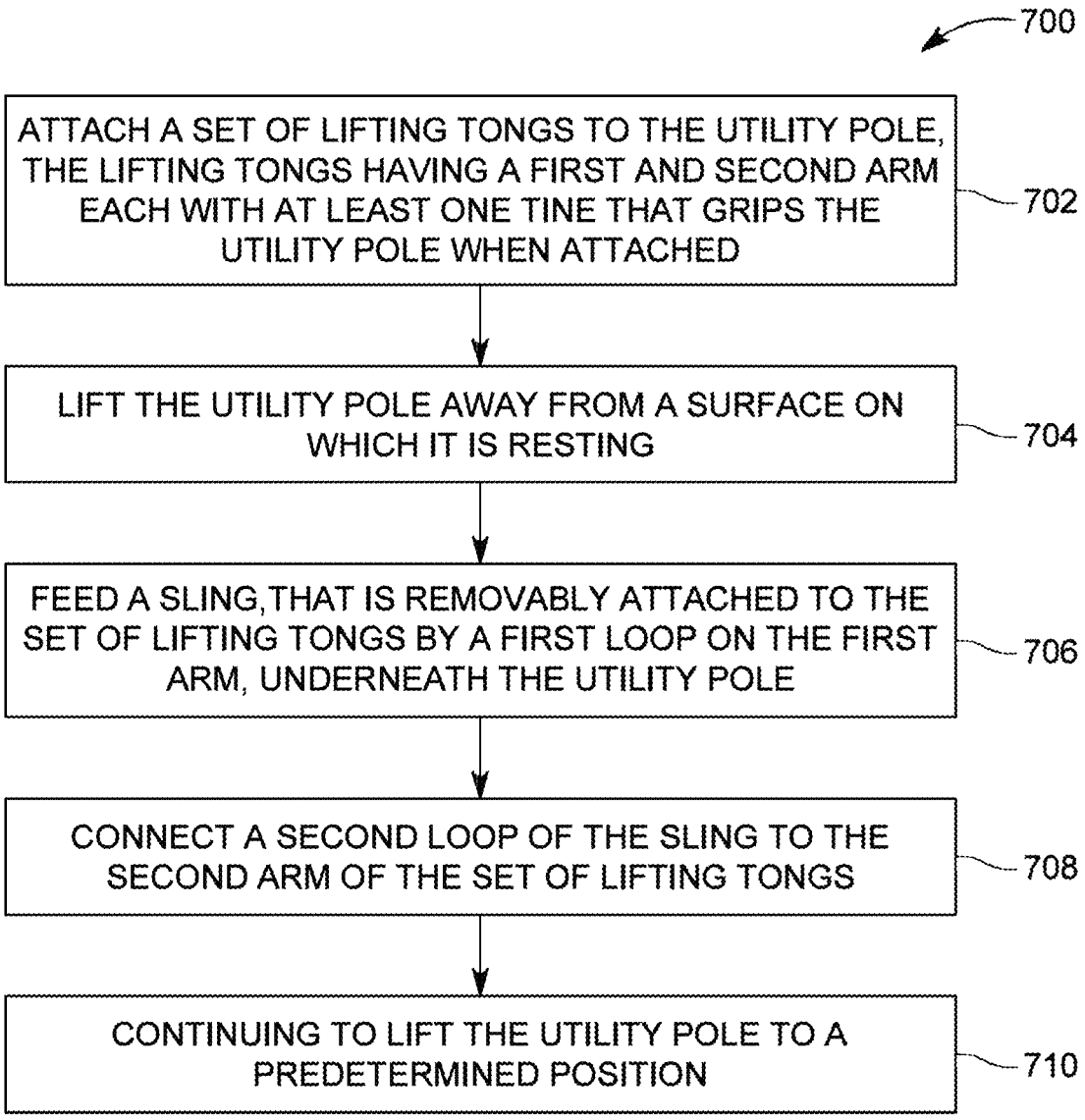
FIG. 7 is a flowchart illustrating a method according to an embodiment.

The embodiments described above have been expressed as systems and/or devices. However, such embodiments can also be expressed as methods. For example, as shown in the flowchart of FIG. 7, an embodiment can be expressed as a method 700 for safely lifting a utility pole from a substantially horizontal position to a substantially vertical position. Therein, a set of lifting tongs is attached to the utility pole at step 702, the lifting tongs having a first and second arm each with at least one tine that grips the utility pole when attached. The utility pole is lifted away from a surface on which it is resting at step 704, e.g., by a few feet to provide clearance for a worker to then attach the safety sling. Next, a safety sling, that is removably attached to the set of lifting tongs by a first loop on the first arm, is fed underneath the utility pole at step 706. A second loop of the safety sling is then connected to the second arm of the set of lifting tongs at step 708. Then, with the safety safety sling in place, the utility pole is lifted into its desired/predetermined position at step 710.

It should be understood that this description is not intended to limit the invention. On the contrary, the embodiments are intended to cover alternatives, modifications and equivalents, which are included in the spirit and scope of the invention. Further, in the detailed description of the embodiments, numerous specific details are set forth in order to provide a comprehensive understanding of the invention. However, one skilled in the art would understand that various embodiments may be practiced without such specific details.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A mechanism adapted to lift utility poles comprising:
- a set of lifting tongs, having a first and second arm, each arm having a pointed end adapted to grip a utility pole;
- a first connection mechanism on said first arm;
- a second connection mechanism on said second arm; and
- a safety sling connectable to said first connection mechanism and said second connection mechanism;
- wherein the safety sling has a first loop on one end thereof and a second loop on the other end thereof,
- wherein the first connection mechanism is adapted to removably retain the first loop of the safety sling and has an opening which is adapted to receive the first loop,
- wherein the first connection includes a hook or a carabiner clip; and
- wherein the second connection mechanism retains the second loop semi-permanently by having a locking mechanism that prevents the second loop of the safety sling from being released unintentionally.

2. The mechanism of claim 1, wherein said safety sling is made of a fabric.

3. The mechanism of claim 1, wherein the safety sling is a chain.

4. The mechanism of claim 3, wherein the second connection mechanism is a Y Fork that is adapted for a link of the chain to be slipped thereover.

5. The mechanism of claim 1, wherein the first and second connection mechanisms include first and second carabiner clips, respectively, and further wherein a first force needed to open the first carabiner clip is less than a second force needed to open the second carabiner clip, wherein the second force operates as said locking mechanism.

6. The mechanism of claim 1, wherein said safety sling can be adjusted between two positions: (a) a disconnected position wherein the safety sling is connected to the first connection mechanism but not the second connection mechanism, and (b) a second connected position wherein the safety sling is connected to both the first connection mechanism and the second connection mechanism.

7. The mechanism of claim 6, wherein the safety sling is adapted to underlie a bottom of the utility pole when in the second connected position.

8. The mechanism of claim 7, wherein the safety sling is adapted to underlie the bottom surface of the utility pole by having a length which creates a drop gap distance between the bottom of the utility pole and the safety sling.

9. The mechanism of claim 8, wherein the drop gap distance is between 0 and 2 feet.

10. A method for safely lifting a utility pole from a substantially horizontal position to a substantially vertical position, the method comprising:

attaching a set of lifting tongs to the utility pole, the lifting tongs having a first and second arm each with at least one tine that grips the utility pole when attached;

lift the utility pole away from a surface on which it is resting;

feeding a safety sling, that is removably attached to the set of lifting tongs by a first loop on the first arm, underneath the utility pole;

connecting a second loop of the safety sling to the second arm of the set of lifting tongs; and continuing to lift the utility pole to a predetermined position wherein the first connection mechanism is adapted to removably retain a first loop of the safety sling and has an opening which is adapted to receive the first loop;

wherein the second connection mechanism is adapted to semi-permanently retain a second loop of the safety sling;

wherein the second connection mechanism retains the second loop semi-permanently by having a locking mechanism that prevents the second loop of the safety sling from being released unintentionally.

11. The method of claim 10, wherein said safety sling is made of one of: a fabric and a chain.

12. The method of claim 10, wherein at least one of the first and second connection mechanisms includes a carabiner clip.

13. The method of claim 10, wherein the first and second connection mechanisms include first and second carabiner clips, respectively, and further wherein a first force needed to open the first carabiner clip is less than a second force needed to open the second carabiner clip, wherein the second force operates as said locking mechanism.

14. The method of claim 10, wherein said safety sling can be adjusted between two positions: (a) a disconnected position wherein the safety sling is connected to the first connection mechanism but not the second connection mechanism, and (b) a second connected position wherein the safety sling is connected to both the first connection mechanism and the second connection mechanism.

15. The method of claim 10, wherein the safety sling is adapted to underlie a bottom of the utility pole when in the second connected position.

16. The method of claim 15, wherein the safety sling is adapted to underlie the bottom surface of the utility pole by having a length which creates a drop gap distance between the bottom of the utility pole and the safety sling.

17. The method of claim 16, wherein the drop gap distance is between 0 and 2 feet.

* * * * *